US007764892B2

(12) United States Patent
Eun et al.

(10) Patent No.: US 7,764,892 B2
(45) Date of Patent: Jul. 27, 2010

(54) UNIFORM GLOSS CONTROL APPARATUS AND METHOD

(75) Inventors: Yongsoon Eun, Rochester, NY (US); Eric S. Hamby, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 462 days.

(21) Appl. No.: 11/940,041

(22) Filed: Nov. 14, 2007

(65) Prior Publication Data

US 2009/0123169 A1 May 14, 2009

(51) Int. Cl.
*G03G 15/20* (2006.01)
*G03G 21/20* (2006.01)

(52) U.S. Cl. ..... 399/67; 399/69; 399/92

(58) Field of Classification Search ..... 399/67, 399/68, 69, 92, 94
See application file for complete search history.

(56) References Cited

U.S. PATENT DOCUMENTS 3,936,658 A 2/1976 Traister et al.
4,088,868 A 5/1978 Zeuthen
4,303,334 A 12/1981 Haupt et al.
5,812,906 A 9/1998 Staudenmayer et al.
5,893,666 A 4/1999 Aslam et al.
5,991,565 A * 11/1999 Hanyu et al. ..... 399/69
6,532,348 B2 * 3/2003 Allmendinger ..... 399/69
6,963,717 B1 11/2005 Klimley et al.
2004/0190925 A1 * 9/2004 Baruch et al. ..... 399/69

* cited by examiner

*Primary Examiner*—David M Gray
*Assistant Examiner*—Joseph S Wong
(74) *Attorney, Agent, or Firm*—Ronald E. Prass, Jr.; Prass LLP

(57) ABSTRACT

In a fusing apparatus including a fuser member and pressure member fusing nip, a controller and sensors, there is provided a method of controlling fused image gloss. The method includes (a) sensing a copy sheet moving into the fusing nip; (b) sensing a temperature of a pre-fusing nip portion of a surface of the fuser member; (c) sensing a temperature of a post-fusing nip portion of the surface of the fuser member; (d) sensing an exit of each copy sheet from the fusing nip; (e) determining a start and an end of each inter-sheet gap portion on the surface of the fuser member; (f) making control calculations using sensed data; and (g) based on the control calculations, applying temperature conditioning only onto an inter-sheet gap portion on the surface of the fuser member for maintaining a near-constant uniform temperature on the surface of the fuser member.

20 Claims, 5 Drawing Sheets

UNIFORM GLOSS CONTROL APPARATUS AND METHOD

The present invention relates to an electrostatographic image producing machine and, more particularly, to such a machine having a fusing apparatus including a uniform gloss control apparatus and method.

One type of electrostatographic reproducing machine is a xerographic copier or printer. In a typical xerographic copier or printer, a photoreceptor surface, for example that of a drum, is generally arranged to move in an endless path through the various processing stations of the xerographic process. As in most xerographic machines, a light image of an original document is projected or scanned onto a uniformly charged surface of a photoreceptor to form an electrostatic latent image thereon. Thereafter, the latent image is developed with an oppositely charged powdered developing material called toner to form a toner image corresponding to the latent image on the photoreceptor surface. When the photoreceptor surface is reusable, the toner image is then electrostatically transferred to a recording medium, such as a sheet of paper, and the surface of the photoreceptor is cleaned and prepared to be used once again for the reproduction of a copy of an original. The sheet of paper with the powdered toner thereon in imagewise configuration is separated from the photoreceptor and moved through a fusing apparatus including a heated fuser member where the toner image thereon is heated and permanently fixed or fused to the sheet of paper.

A common image quality defect of a fuser roller type fusing apparatus is lead-edge induced gloss variation or inter-sheet gap induced gloss variation. This occurs because when image carrying copy papers or sheets are run through a fusing nip formed by a rotating heated fuser roller and a rotating pressure member, there is usually a timing and space gap between consecutive sheets (inter-sheet gap) even while the fuser roller continues to rotate through the fusing nip. Each copy paper or sheet ordinarily draws heat from the portions of the fuser roller surface it contacts while passing through the fusing nip. The contacted portions thus lose heat. The inter-paper or inter-sheet gap however does not lose heat, and thus a sharp, a step-like thermal gradient is created on the roller surface between portions contacted and inter-sheet gap portions.

Typically, in order to completely feed a copy paper or sheet short edge first through a fusing nip, the entire circumference of a heated fuser roller contacts the sheet "n+f" times—where "n" is an integer and "f" is a fraction. As such, the exact locations of inter-sheet gaps on the surface of the fuser roller will vary circumferentially each time the fuser roller rotates. The location of inter-sheet gaps will additionally depend on the length of the type of copy sheet, and on the speeds of the fuser roller and the copy sheet transport system. Each inter-sheet gap of course will always extend axially on the surface of the fuser roller to the extent of the width of the copy sheet, and as pointed out above, it remains at a relatively higher temperature than the fully contacted portions—hence the step-like temperature gradient. As an undesirable consequence, this thermal step-like gradient causes gloss variations when the relatively higher temperature inter-paper gap portion from a preceding copy sheet fusing operation subsequently contacts a following image carrying copy sheet.

Examples of prior art references that may be relevant to the present disclosure include U.S. Pat. No. 4,303,334 issued Dec. 1, 1981 to Haupt et al. and entitled "Heat regulator for the fusing device in an electrostatic copier" that discloses a heat regulator for a fuser in a reproduction machine. The heat regulator includes a fuser cooling fan, and a controller having a cooling fan counter. The cooling fan counter manifests the number of copies reproduced up to a predetermined maximum in response to a document scan switch. The contents of the cooling fan counter is the basis for determining the length of time of operation of the cooling fan at the end of a reproduction run. Specifically, the machine cooling fan maintains operation during machine cycle out at the end of a reproduction run for a three second period for each count in the cooling fan counter up to a predetermined maximum.

U.S. Pat. No. 4,088,868 issued May 9, 1978 to Zeuthen and entitled "Fuser cooling system" discloses a radiant heat fuser for an electrostatic copying machine in which heat for fusing the delicate toner image on top of a sheet is applied using a top heater of radiant type, and background heat to the underside of the sheet is provided by means of heat-absorbing and -radiating elements positioned in the fuser bed and arranged to absorb radiant heat while no sheet is being fed and to radiate and convect heat to the underside of the sheet as it passes through the fuser. The control of the temperature of these heat-absorbing and -radiating elements is achieved by way of a cooling air system throttled in accordance with temperature-responsive deformation of the heat-absorbing and -radiating elements some of which are accordingly of bimetallic form.

U.S. Pat. No. 3,936,658 issued Feb. 3, 1976, 176 to Traister et al. and entitled "Fuser apparatus for electrostatic reproducing machines" discloses in an electrostatic reproducing machine an improved fusing apparatus for fusing xerographic images onto copy sheets. The fusing apparatus comprises various actuable means including a pressure roller, a fuser roller, means for engaging and disengaging the pressure roller against the fuser roller, means for cooling end portions of the pressure roller, means for lubricating the fuser roller, and control means for actuating the various actuable means in a timed order and sequence to effect the fusing operation.

U.S. Pat. No. 6,963,717 issued Nov. 8, 2005 to Klimley et al. and entitled "Fuser stripper baffle and a printing machine including the same" discloses a fuser stripper baffle exit minimizes differential gloss marks due to paper contacting the fuser exit baffle. Portions of paper that touch the baffle cool differently than portions that don't, resulting in differential gloss in the paper path or spanwise direction. The exit baffle contains a series of axial-direction steps or plateaus in its upper surface, such that the highest step is nearest the fuser roller, while the lowest plateau is furthest from the roller. This reduces the surface area of the fuser stripper baffle exit that contacts the surface of the paper sheet as the paper sheet is stripped from the fuser roller. The paper thus touches the exit baffle for the minimum amount of time, thus minimizing the heat transfer to the baffle. This minimizes differential cooling effects which, in turn, minimizes differential gloss.

U.S. Pat. No. 5,893,666 issued Apr. 13, 1999 to Aslam et al. and entitled "Cooling and reusing the heat to preheat the fusing web in a belt fuser" discloses a belt fusing apparatus for providing image gloss to a colorant image formed on a receiver member by a reproduction apparatus. The belt fusing apparatus includes a heated fuser roller, a pressure roller in nip relation with the fuser roller, and a steering roller. A fusing belt is entrained about the fuser roller and the steering roller for movement in a predetermined direction about a closed loop path. A cooling air flow is directed at the fusing belt over an area adjacent to the steering roller upstream of the steering roller. The cooling air flow, heated by the action of the air flow cooling the fusing belt, is captured and directed at the fusing belt downstream of the steering roller to preheat the fusing belt.

U.S. Pat. No. 5,812,906 issued Sep. 22, 1998 to Staudenmayer et al. and entitled "Fuser having thermoelectric temperature control" discloses a fuser for fixing toner, for example, toner images, includes thermoelectric control devices for controlling temperature. Preferably, the thermoelectric control devices are used to heat the toner in a heating zone and cool the toner in a cooling zone prior to separation of the toner from a fusing surface. The cooling improves both the gloss and the separation characteristics of the toner.

In accordance with the method and apparatus of the present disclosure, there is provided a method of controlling fused image gloss from a toner image fusing apparatus having a controller and a heated rotating fuser member forming a fusing nip with a rotating pressure member. The method includes (a) sensing a copy sheet moving into the fusing nip; (b) sensing a temperature of a pre-fusing nip portion of a surface of the fuser member; (c) sensing a temperature of a post-fusing nip portion of the surface of the fuser member; (d) sensing an exit of each copy sheet from the fusing nip; (e) determining a start and an end of each inter-sheet gap portion on the surface of the fuser member; (f) making control calculations using sensed data; and (g) based on the control calculations, applying temperature conditioning only onto an inter-sheet gap portion on the surface of the fuser member for maintaining a near-constant uniform temperature on the surface of the fuser member.

Figure 1:
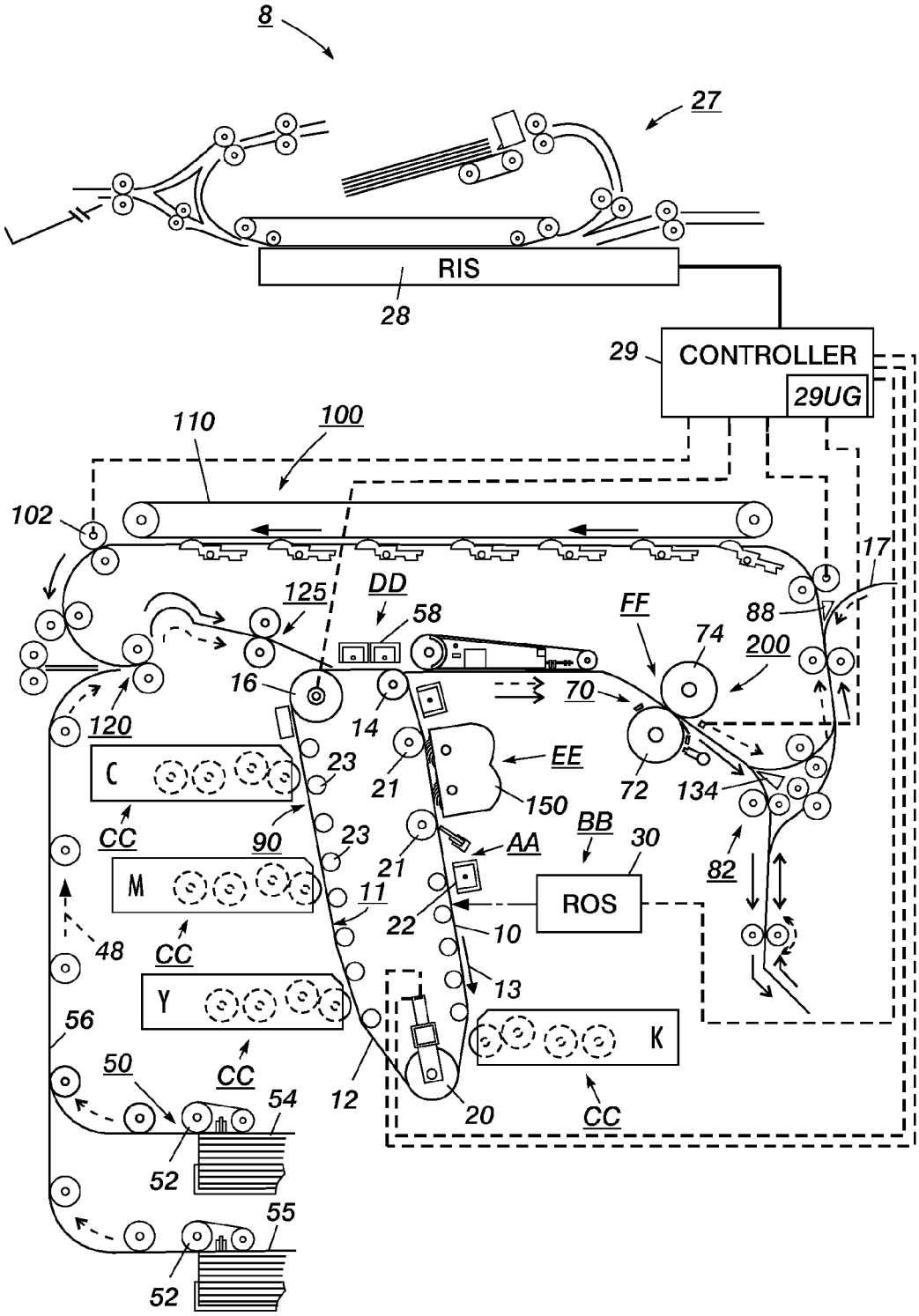
FIG. 1 is a schematic elevational view of an exemplary electrostatographic reproduction machine including a fusing apparatus having a uniform gloss control method and apparatus in accordance with the present disclosure.
Figure 2:
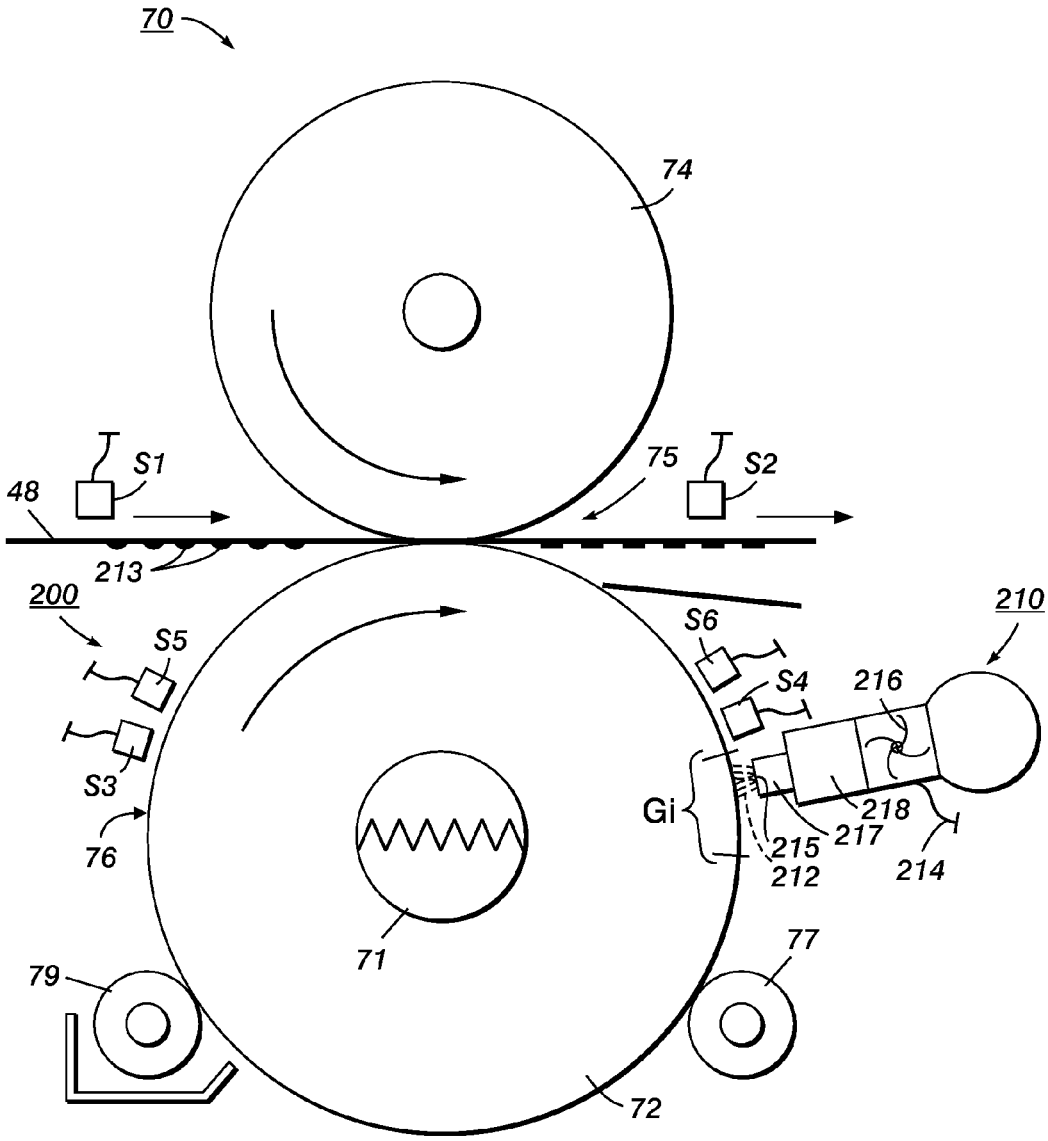
FIG. 2 is an enlarged end section schematic the roller/roller embodiment of the fusing apparatus of FIG. 1 including a first embodiment of the uniform gloss control method and apparatus in accordance with the present disclosure.
Figure 4:
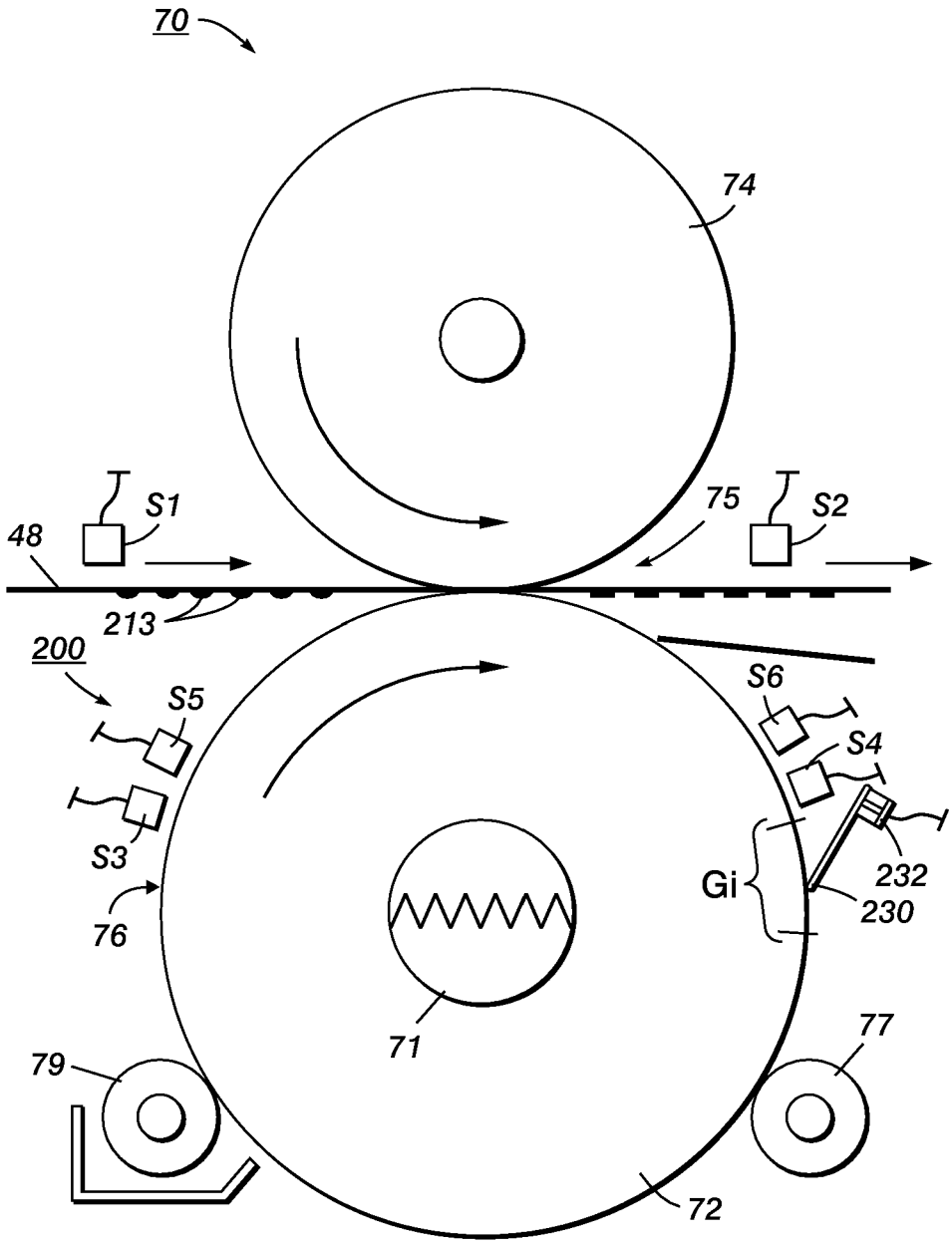
Figure 5:
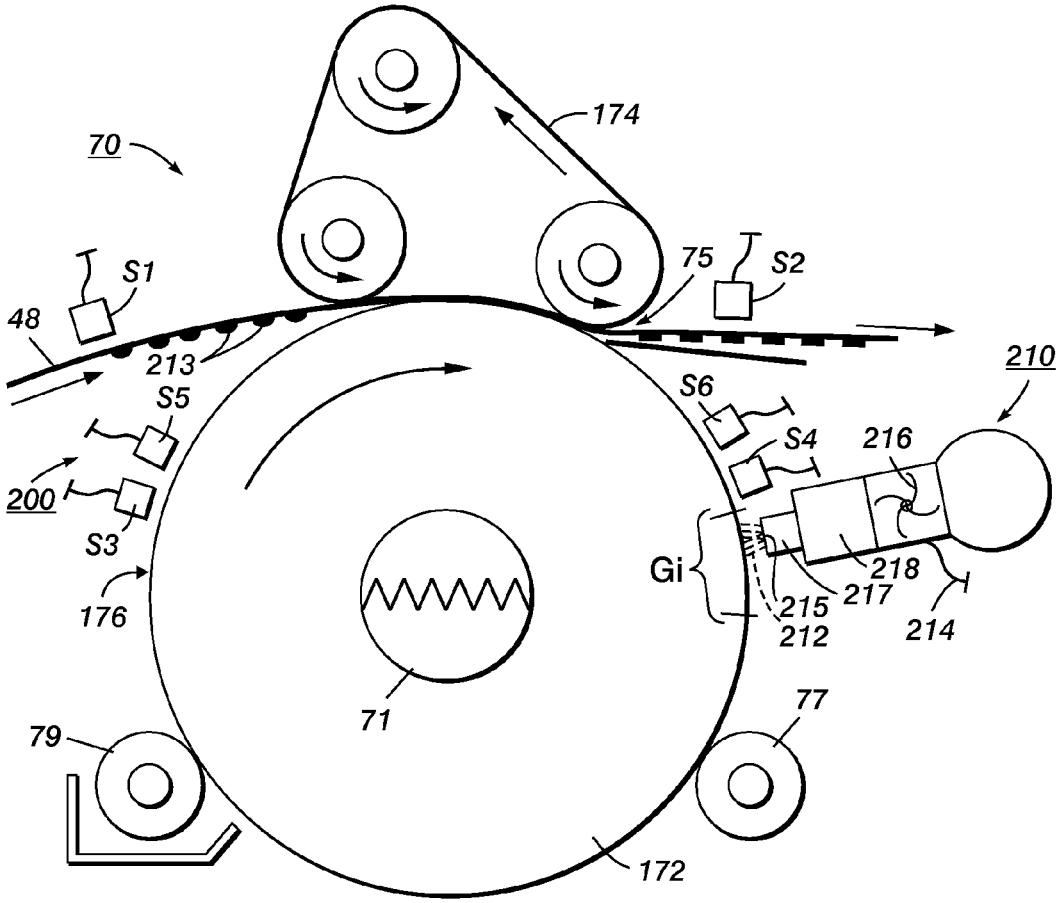

FIG. 4 is an enlarged end section schematic of the fusing apparatus of FIG. 2 including a third embodiment of the uniform gloss control method and apparatus in accordance with the present disclosure; and FIG. 5 is an enlarged end section schematic a roller/belt embodiment of the fusing apparatus of FIG. 1 including a first embodiment of the uniform gloss control method and apparatus in accordance with the present disclosure.

Referring first to FIG. 1, it schematically illustrates an electrostatographic reproduction machine 8 that generally employs a photoconductive belt 10 mounted on a belt support module 90. Preferably, the photoconductive belt 10 is made from a photoconductive material coated on a conductive grounding layer that, in turn, is coated on an anti-curl backing layer. Belt 10 moves in the direction of arrow 13 to advance successive portions sequentially through various processing stations disposed about the path of movement thereof. Belt 10 is entrained as a closed loop 11 about stripping roller 14, drive roller 16, idler roller 21, and backer rollers 23.

Initially, a portion of the photoconductive belt surface passes through charging station AA. At charging station AA, a corona-generating device indicated generally by the reference numeral 22 charges the photoconductive belt 10 to a relatively high, substantially uniform potential.

As also shown the reproduction machine 8 includes generally a controller or electronic control subsystem (ESS) 29 that is preferably a self-contained, dedicated minicomputer having a central processor unit (CPU), electronic storage, and a display or user interface (UI). The ESS 29, with the help of sensors and connections, can read, capture, prepare and process image data and machine status information.

Still referring to FIG. 1, at an exposure station BB, the controller or electronic subsystem (ESS), 29, receives the image signals from RIS 28 representing the desired output image and processes these signals to convert them to a continuous tone or gray scale rendition of the image that is transmitted to a modulated output generator, for example the raster output scanner (ROS), indicated generally by reference numeral 30. The image signals transmitted to ESS 29 may originate from RIS 28 as described above or from a computer, thereby enabling the electrostatographic reproduction machine 8 to serve as a remotely located printer for one or more computers. Alternatively, the printer may serve as a dedicated printer for a high-speed computer. The signals from ESS 29, corresponding to the continuous tone image desired to be reproduced by the reproduction machine, are transmitted to ROS 30.

ROS 30 includes a laser with rotating polygon mirror blocks. Preferably a nine-facet polygon is used. At exposure station BB, the ROS 30 illuminates the charged portion on the surface of photoconductive belt 10 at a resolution of about 300 or more pixels per inch. The ROS will expose the photoconductive belt 10 to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image through development stations CC, that include four developer units as shown, containing CMYK color toners, in the form of dry particles. At each developer unit the toner particles are appropriately attracted electrostatically to the latent image using commonly known techniques.

With continued reference to FIG. 1, after the electrostatic latent image is developed, the toner powder image present on belt 10 advances to transfer station DD. A print sheet 48 is advanced to the transfer station DD, by a sheet feeding apparatus 50. Sheet-feeding apparatus 50 may include a corrugated vacuum feeder (TCVF) assembly 52 for contacting the uppermost sheet of stack 54, 55. TCVF 52 acquires each top sheet 48 and advances it to vertical transport 56. Vertical transport 56 directs the advancing sheet 48 through feed rollers 120 into registration transport 125, then into image transfer station DD to receive an image from photoreceptor belt 10 in a timed. Transfer station DD typically includes a corona-generating device 58 that sprays ions onto the backside of sheet 48. This assists in attracting the toner powder image from photoconductive surface 12 to sheet 48. After transfer, sheet 48 continues to move in the direction of arrow 60 where it is picked up by a pre-fuser transport assembly and forwarded to fusing station FF.

Fusing station FF includes the uniform gloss fuser or fusing apparatus of the present disclosure that is indicated generally by the reference numeral 70 and shown as a roller/roller type fuser. As is well known, fusers can be roller/roller, that is, they comprise a fuser roller 72, 172 forming a fusing nip 75 with a pressure member that is also a roller 74, 174 as shown. They can also be roller/belt as shown in FIG. 5 and comprise a fuser roller 172, 172 forming a fusing nip 175 with a pressure member that is a belt 174, 174. Furthermore, they can be belt/belt (not shown but well known) comprising a belt fuser member forming a fusing nip with a belt pressure member. In each case however, the fusing apparatus will be suitable for fusing and permanently affixing transferred toner images 213 with a uniform gloss to copy sheets 48.

As further illustrated, after fusing, the sheet 48 then passes to a gate 88 that either allows the sheet to move directly via output 17 to a finisher or stacker, or deflects the sheet into the duplex path 100. Specifically, the sheet (when to be directed into the duplex path 100), is first passed through a gate 134 into a single sheet inverter 82. That is, if the second sheet is either a simplex sheet, or a completed duplexed sheet having both side one and side two images formed thereon, the sheet will be conveyed via gate 88 directly to output 17. However, if the sheet is being duplexed and is then only printed with a side one image, the gate 88 will be positioned to deflect that sheet into the inverter 82 and into the duplex loop path 100, where that sheet will be inverted and then fed to acceleration nip 102 and belt transports 110, for recirculation back through transfer station DD and fuser 70 for receiving and permanently fixing the side two image to the backside of that duplex sheet, before it exits via exit path 17.

After the print sheet is separated from photoconductive surface 12 of belt 10, the residual toner/developer and paper fiber particles still on and may be adhering to photoconductive surface 12 are then removed there from by a cleaning apparatus 150 at cleaning station EE.

Referring now to FIGS. 1-5, the electrostatographic reproduction machine 8 thus can be seen to include (a) a moveable imaging member 10 that includes an imaging surface 12; (b) imaging means or devices 22, 30 , K, Y, M, C for forming and transferring a toner image onto a toner image carrying sheet 48; (c) a fusing apparatus 70 including a heated rotating fuser member shown in the form of a fuser roller 72, 172 and a rotating pressure member 74, 174 forming a fusing nip 75 with the heated rotating fuser roller; and (d) a gloss control apparatus 200 in accordance to the present disclosure for controlling fused image gloss from the fusing apparatus. The disclosure will be described with reference to a fuser roller and pressure roller (roller/roller), but it is well understood that it will work equally well too with a roller/belt fuser member/pressure member or belt/belt fuser member/pressure member type fusing apparatus.

As illustrated, the gloss control apparatus 200 includes (i) sensors S1, S2 located along a path of travel of the copy sheet 48 into the fusing nip 75, and connected to the controller 29, 29UG for sensing and timing an entrance of a copy sheet moving into contact with a surface 76, 176 of the heated rotating fuser roller within the fusing nip, and an exit of the copy sheet from the fusing nip; (ii) sensors S3, S5 located on the upstream side of the fusing nip adjacent the surface 76, 176 of the fuser roller and connected to the controller 29 for sensing a temperature of a pre-fusing nip portion of the surface of the heated rotating fuser roller; (iii) sensors S4, S6 located on the downstream side of the fusing nip adjacent the surface 76, 176 of the fuser roller and connected to the controller 29 for sensing a temperature of a post-fusing nip portion of the surface of the heated rotating fuser roller; and (iv) a control program 29UG of the controller 29 for determining a start and an end of an inter-sheet gap portion "Gi" on the surface of the heated rotating fuser roller during fusing operation of a series of copy sheets. The sensors S3 and S4 for example can be used to sense the temperatures of inter-sheet gap portions Gi before and after the fusing nip 75, and the sensors S5 and S6 can be used to similarly sense the temperatures of non-gap portions of the surface 76, 176. Calculated differences between pairs of these sensed temperatures are then used by the controller to determine the need, rate and intensity of application of the temperature conditioning device 210, 220, 230 so as to smooth out any temperature gradients, thus achieving assured uniform gloss.

The gloss control apparatus 200 also includes a temperature conditioning device, such as an on and off cooling device 210, 220, 230 for contacting the surface 76, 176 of the heated rotating fuser roller 72, 172, and programmable aspects including the program 29UG of the controller 29 for storing and supplying copy sheet type information and making control calculations using stored information and the sensed data from the sensors S1-S6, and further for controlling the on and off cooling device 210, 220, 230 to only cool the inter-sheet gap portion Gi of the surface of the heated rotating fuser roller.

In a first embodiment as shown in FIG. 2, the temperature conditioning or on and off cooling device 210, 220, 230 comprises a source 210 of a compressed cool jet of air 212 (shown in an mode position) that is connected via 214 to the controller 29. As further illustrated, the source 210 includes a blower 216, and suitable air cooling means 218 for rapidly adjusting the temperature of the jet of air 212. The jet of air 212 is blown through a narrow slit 215 in a nozzle 217.

Figure 3:
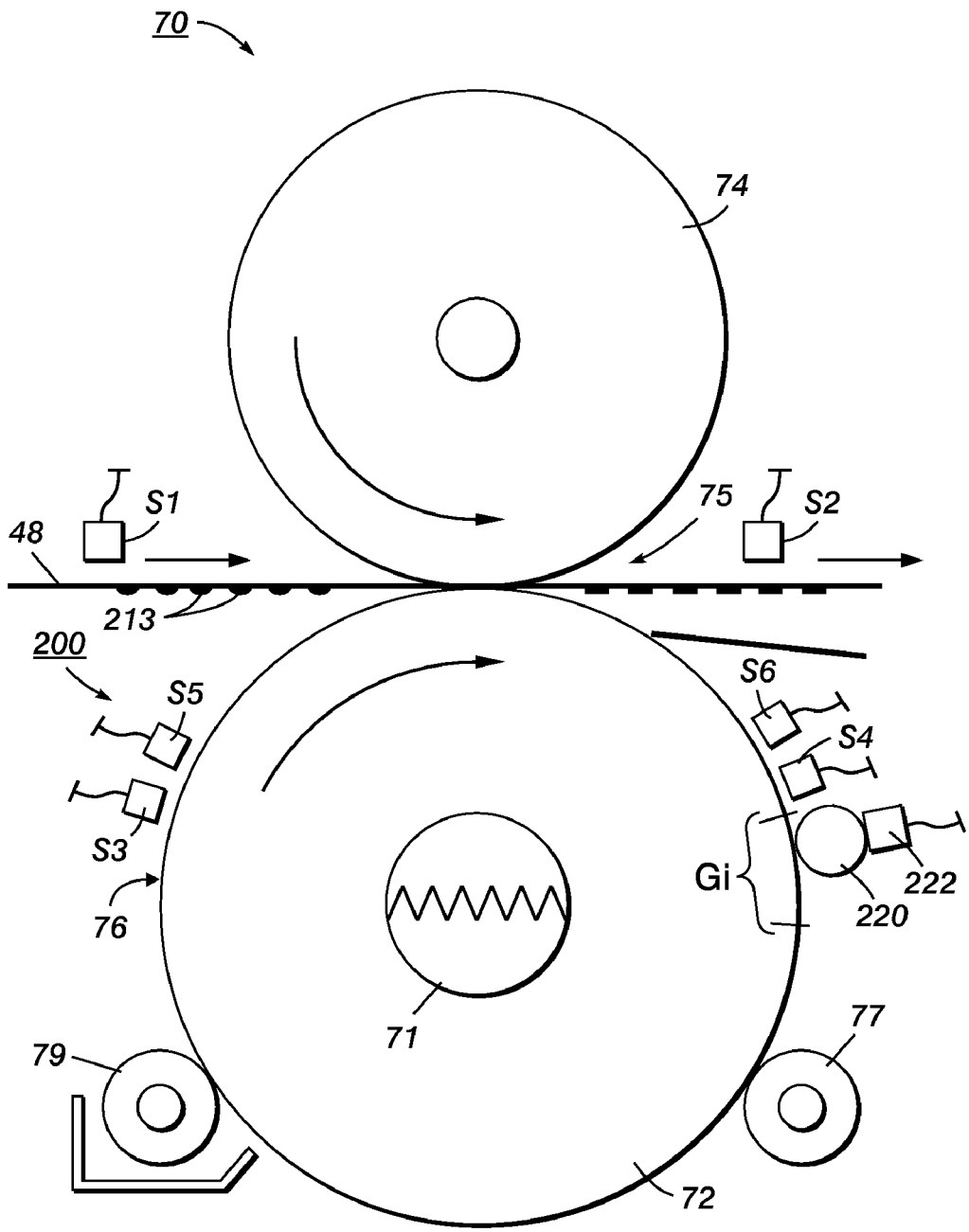
FIG. 3 is an enlarged end section schematic of the fusing apparatus of FIG. 2 including a second embodiment of the uniform gloss control method and apparatus in accordance with the present disclosure.

In a second embodiment as shown in FIG. 3, the temperature conditioning or on and off cooling device 210, 220, 230 comprises a retractable rotating chilled roller 220 that is moveable such as by suitable means 222 (shown in a down position) connected to the controller 29 into and out of contact with the inter-sheet gap portion Gi of the surface of the heated rotating fuser roller. In a third embodiment as shown in FIG. 4, the on and off cooling device 210, 220, 230 comprises a sliding chilled tip 230 that is moveable such as by suitable means 232 (shown in a down position) connected to the controller 29 into and out of contact with the inter-sheet gap portion of the surface of the heated rotating fuser roller.

In each case however, the on and off cooling device 210, 220, 230 is controlled for maintaining a near-constant uniform post-fusing nip temperature on all portions of the surface 76, 176 of the heated rotating fuser roller 72, 172. The controller 29 is programmed to determine a temperature difference of a portion of the surface of the heated rotating fuser roller in a pre-fusing nip position and in a post-fusing nip position. The controller also is programmed to determine a post-fusing nip temperature difference between an inter-sheet gap portion Gi and a non inter-sheet gap portion of the surface 76, 176 of the heated rotating fuser roller.

Thus in accordance with the present disclosure, a cooled high pressure air jet 212 for example, is used to smooth thermal gradients on the surface 76, 176 of a heated fuser roller 72, 172 in the circumferential direction. The air jet 212 is sent through a nozzle 217 having a narrow slit 215 for localizing the application and cooling effect of the air jet, and timing of the application is coordinated by the controller 29 with copy sheet transport or movement in and through the fusing nip 75. As such, the air jet 212 is actuated and applied exactly only on the location (inter-sheet gap Gi exiting the fusing nip) where a sharp thermal gradient would otherwise be located. The machine and fusing apparatus controller 29 also programmable with copy sheet and operation type information, and thus receives, stores and utilizes copy sheet type, size and speed information data from the machine digital front end (DFE), as well as signals from the copy sheet transport system and the xerographic or imaging (IOT) unit of the machine. The controller then actively determines and controls the temperature, timing and intensity of the air jet 212.

In addition, in accordance with the present disclosure, the method of controlling fused image gloss from a toner image fusing apparatus 70 having sensors S1, S2, S3, S4, S5, S6, a controller 29 and a heated rotating fuser roller 72, 172 forming a fusing nip 75 with a rotating pressure member 74, 174 includes (a) sensing and timing an entrance of a copy sheet 48 moving into contact with a surface of the heated rotating fuser roller; (b) sensing a temperature of a pre-fusing nip portion of the surface of the heated rotating fuser roller; (c) sensing a temperature of a post-fusing nip portion of the surface of the heated rotating fuser roller; (d) sensing and timing an exit of each copy sheet from the fusing nip; (e) determining a start and an end of each inter-sheet gap portion on the surface of the heated rotating fuser roller when a series of copy sheets are being fused through the fusing nip; (f) making control calculations using sensed data; and (g) based on the control calculations, applying temperature conditioning means only onto an inter-sheet gap portion on the surface of the heated rotating fuser roller for maintaining a near-constant uniform temperature for the surface of the heated rotating fuser roller.

The step of making control calculations includes determining a temperature difference of a portion of the surface of the heated rotating fuser roller in a pre-fusing nip position and in a post-fusing nip position. The step of making control calculations includes determining a post-fusing nip temperature difference between an inter-sheet gap portion and a non inter-sheet gap portion of the surface of the heated rotating fuser roller. The step of applying a temperature conditioning means comprises directing and controlling a cooled compressed jet of air on and off into contact with the inter-sheet gap portion of the surface of the heated rotating fuser roller. The step of applying a temperature conditioning means only onto the inter-sheet gap portion comprises moving a rotating chilled roller into and out of contact with the inter-sheet gap portion of the surface of the heated rotating fuser roller. The step of applying a temperature conditioning means only onto the inter-sheet gap portion comprises moving a sliding chilled tip into and out of contact with the inter-sheet gap portion of the surface of the heated rotating fuser roller.

An alternative method of the present disclosure can includes a) sensing gloss on a copy sheet exiting from the fusing nip using a gloss sensor (not shown); (b) determining a start and an end of each inter-sheet gap portion on the surface of the fuser member; (f) making control calculations using sensed data; and (g) based on the control calculations, applying temperature conditioning only onto an inter-sheet gap portion on the surface of the fuser member for maintaining a near-constant uniform temperature on the surface of the fuser member.

Thus in a two-roller fusing apparatus 70 comprising a moving fuser roller 72, 172 and pressure roller 74, 174 forming a fusing nip 75 through which copy sheets 48 being fused are fed in series with inter-sheet gaps Gi between copy sheets, a conditioned high pressure jet 212 of compressed air is controllably applied against a portion of an external surface 76, 176 of the moving fuser roller only within an inter-sheet gap Gi for tempering a temperature of that portion of the external surface and hence for smoothing out an otherwise step-like thermal gradient on the external surface of the moving fuser roller in a circumferential direction as the moving fuser roller is rotated. The conditioned high pressure jet 212 of compressed air is applied via a narrow nozzle slit 215 in a controlled manner for localizing a conditioning effect thereof. On and off control of an application of the conditioned high pressure jet 212 is coordinated with copy sheet movement into the fusing nip so that the jet is focused to start and to stop exactly within an inter-sheet gap. The controller 29 of the fusing apparatus receives copy sheet data (copy sheet type, size and speed) from the machine digital front end for example, as well as signal data from sensors on (i) the copy sheet transport system, (ii) the xerographic image output terminal, and (ii) the fusing apparatus itself (size, speed, temperature, copy sheet intake and release), in order to actively determine the timing, temperature conditioning and intensity of the jet of compressed air being applied.

As can be seen, there has been provided in a fusing apparatus including a fuser member and pressure member fusing nip, a controller and sensors, a method of controlling fused image gloss. The method includes (a) sensing a copy sheet moving into the fusing nip; (b) sensing a temperature of a pre-fusing nip portion of a surface of the fuser member; (c) sensing a temperature of a post-fusing nip portion of the surface of the fuser member; (d) sensing an exit of each copy sheet from the fusing nip; (e) determining a start and an end of each inter-sheet gap portion on the surface of the fuser member; (f) making control calculations using sensed data; and (g) based on the control calculations, applying temperature conditioning only onto an inter-sheet gap portion on the surface of the fuser member for maintaining a near-constant uniform temperature on the surface of the fuser member.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A method of controlling fused image gloss from a toner image fusing apparatus having sensors, a controller and a heated rotating fuser member forming a fusing nip with a rotating pressure member, the method comprising:

(a) sensing and timing an entrance of a copy sheet moving into contact with a surface of said heated rotating fuser member;

(b) sensing a temperature of a pre-fusing nip portion of said surface of said heated rotating fuser member;

(c) sensing a temperature of a post-fusing nip portion of said surface of said heated rotating fuser member;

(d) sensing and timing an exit of each copy sheet from said fusing nip;

(e) determining a start and an end of each inter-sheet gap portion on said surface of said heated rotating fuser member when a series of copy sheets are being fused through said fusing nip;

(f) making control calculations using sensed data; and (g) based on said control calculations, applying temperature conditioning means only onto an inter-sheet gap portion on said surface of said heated rotating fuser member for maintaining a near-constant uniform temperature for said surface of said heated rotating fuser member.

2. The method of claim 1, wherein making control calculations includes determining a temperature difference of a portion of said surface of said heated rotating fuser member in a pre-fusing nip position and in a post-fusing nip position.

3. The method of claim 1, wherein making control calculations includes determining a post-fusing nip temperature difference between an inter-sheet gap portion and a non inter-sheet gap portion of said surface of said heated rotating fuser member.

4. The method of claim 1, wherein applying a temperature conditioning means comprises directing and controlling a compressed jet of cooled air on and off into contact with said inter-sheet gap portion of said surface of said heated rotating fuser member.

5. The method of claim 1, wherein applying a temperature conditioning means only onto said inter-sheet gap portion comprises moving a rotating chilled roller into and out of contact with said inter-sheet gap portion of said surface of said heated rotating fuser member.

6. The method of claim 1, wherein applying a temperature conditioning means only onto said inter-sheet gap portion comprises moving a sliding chilled tip into and out of contact with said inter-sheet gap portion of said surface of said heated rotating fuser member.

7. A gloss control apparatus for controlling fused image gloss from a toner image fusing apparatus having a heated rotating fuser member forming a fusing nip with a rotating pressure member, the gloss control apparatus comprising:

(a) sensors for (i) sensing and timing an entrance of a copy sheet moving into contact with a surface of said heated rotating fuser member; (ii) sensing a temperature of a pre-fusing nip portion of said surface of said heated rotating fuser member; (iii) sensing a temperature of a post-fusing nip portion of said surface of said heated rotating fuser member; (iv) sensing an exit of each copy sheet from the fusing nip; (v) sensing and timing an exit of each copy sheet from said fusing nip (vi) determining a start and an end of each inter-sheet gap portion on the surface of the fuser member;

(b) an on and off cooling device for contacting said surface of said heated rotating fuser member; and (c) a controller for making control calculations using sensed data and for controlling said on and off cooling device to only cool said inter-sheet gap portion of said surface of said heated rotating fuser member based on said control calculations.

8. The gloss control apparatus of claim 7, wherein said on and off cooling device is controlled for maintaining a near-constant uniform post-fusing nip temperature on all portions of said surface of said heated rotating fuser member.

9. The gloss control apparatus of claim 7, wherein said controller is programmed to determine a temperature difference of a portion of said surface of said heated rotating fuser member in a pre-fusing nip position and in a post-fusing nip position.

10. The gloss control apparatus of claim 7, wherein said controller is programmed to determine a post-fusing nip temperature difference between an inter-sheet gap portion and a non inter-sheet gap portion of said surface of said heated rotating fuser member.

11. The gloss control apparatus of claim 7, wherein said on and off cooling device comprises a compressed jet of air.

12. The gloss control apparatus of claim 7, wherein said on and off cooling device comprises a retractable rotating chilled roller that is moveable into and out of contact with said inter-sheet gap portion of said surface of said heated rotating fuser member.

13. The gloss control apparatus of claim 7, wherein said on and off cooling device comprises a sliding chilled tip that is moveable into and out of contact with said inter-sheet gap portion of said surface of said heated rotating fuser member.

14. A fusing apparatus comprising:

(a) a heated rotating fuser member;

(b) a rotating pressure member forming a fusing nip with said heated rotating fuser member; and (c) a gloss control apparatus for controlling fused image gloss from said fusing apparatus, the gloss control apparatus including:

(i)) sensors for (i) sensing and timing an entrance of a copy sheet moving into contact with a surface of said heated rotating fuser member; (ii) sensing a temperature of a pre-fusing nip portion of said surface of said heated rotating fuser member; (iii) sensing a temperature of a post-fusing nip portion of said surface of said heated rotating fuser member; (iv) sensing and timing a start and an end of each inter-sheet gap portion on said surface of said heated rotating fuser member when a series of copy sheets are being fused through said fusing nip; (v) sensing and timing an exit of each copy sheet from said fusing nip;

(ii) an on and off cooling device for contacting said surface of said heated rotating fuser member; and (iii) a controller for making control calculations using sensed data and for controlling said on and off cooling device to only cool said inter-sheet gap portion of said surface of said heated rotating fuser member based on said control calculations.

15. The fusing apparatus of claim 14, wherein said on and off cooling device comprises a compressed jet of air.

16. The fusing apparatus of claim 14, wherein said on and off cooling device comprises a retractable rotating chilled roller that is moveable into and out of contact with said inter-sheet gap portion of said surface of said heated rotating fuser member.

17. The fusing apparatus of claim 14, wherein said on and off cooling device comprises a sliding chilled tip that is moveable into and out of contact with said inter-sheet gap portion of said surface of said heated rotating fuser member.

18. An electrostatographic reproduction machine comprising:

(a) a moveable imaging member including an imaging surface;

(b) imaging means for forming and transferring a toner image onto a toner image carrying sheet;

(c) a fusing apparatus including a heated rotating fuser member and a rotating pressure member forming a fusing nip with said heated rotating fuser member; and (d) a gloss control apparatus for controlling fused image gloss from said fusing apparatus, the gloss control apparatus including:

(i)) sensors for (i) sensing and timing an entrance of a copy sheet moving into contact with a surface of said heated rotating fuser member; (ii) sensing a temperature of a pre-fusing nip portion of said surface of said heated rotating fuser member; (iii) sensing a temperature of a post-fusing nip portion of said surface of said heated rotating fuser member; (iv) sensing and timing a start and an end of each inter-sheet gap portion on said surface of said heated rotating fuser member when a series of copy sheets are being fused through said fusing nip; (v) sensing and timing an exit of each copy sheet from said fusing nip;

(ii) an on and off cooling device for contacting said surface of said heated rotating fuser member; and (iii) a controller for making control calculations using sensed data and for controlling said on and off cooling device to only cool said inter-sheet gap portion of said surface of said heated rotating fuser member based on said control calculations.

19. The electrostatographic reproduction machine of claim 18, wherein said on and off cooling device comprises a compressed jet of air.

20. The electrostatographic reproduction machine of claim 18, wherein said on and off cooling device comprises a retractable rotating chilled roller that is moveable into and out of contact with said inter-sheet gap portion of said surface of said heated rotating fuser member.

* * * * *